US006776284B2

(12) United States Patent
Mamiye

(10) Patent No.: US 6,776,284 B2
(45) Date of Patent: Aug. 17, 2004

(54) RESEALABLE SECTIONAL BREATH STRIP CASE

(76) Inventor: Marc J. Mamiye, 2402 Central Ave., Aberdeen, NJ (US) 07747

( * ) Notice: Subject to any disclaimer, the term of this patent is extended or adjusted under 35 U.S.C. 154(b) by 150 days.

(21) Appl. No.: 10/281,241

(22) Filed: Oct. 28, 2002

(65) Prior Publication Data

US 2004/0079665 A1 Apr. 29, 2004

(51) Int. Cl.[7] ..... B65D 71/00
(52) U.S. Cl. ..... 206/425; 206/800; 220/4.27
(58) Field of Search ..... 206/736, 738, 206/745, 747, 748, 749, 541, 425, 800; 220/4.26, 4.27, 6, 7

(56) References Cited

U.S. PATENT DOCUMENTS 5,435,449 A * 7/1995 Gelardi ..... 206/425
6,047,841 A * 4/2000 Chen ..... 220/7
6,321,925 B1 * 11/2001 Crouse et al. ..... 220/4.27

* cited by examiner

*Primary Examiner*—Jacob K. Ackun, Jr.
(74) *Attorney, Agent, or Firm*—Charles I. Brodsky

(57) ABSTRACT

A releasable case for oral breath strips having a base including a cavity, a cover closing the base but having an opening in a top surface for accessing the cavity, and a lid for opening and closing the cover, with the cover closing the base in a non-easily openable fit and with the lid snugly overlying the cover when closed in a substantially air-tight fit.

13 Claims, 1 Drawing Sheet

12
38
A
38
34
32
30
32
38
22
18
10
16
20
18
14
46
24
36
24
18
40
B
50
51

RESEALABLE SECTIONAL BREATH STRIP CASE

CROSS-REFERENCE TO RELATED APPLICATIONS

None

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to oral breath strips, in general, and to a resealable case for the easy carrying about of such breath strips, in particular.

2. Description of the Related Art

As is well known and understood, the use of oral breath strips as mouth fresheners is gaining wider acceptance through advertising and through word-of-mouth recommendations. Commonly made available for sale in 24 or 30 strip packages, a need has been determined to exist to make their carrying case easy to handle and store in one's pocket or purse in allowing for retail sale at reasonable cost. Besides advantageously having a feature of "tamper-proof" construction in affording a degree of security in use, cases of these types also would benefit from an ability to allow removal of individual strips in a sanitary fashion—all in an easy and simple manner.

SUMMARY OF THE INVENTION

As will become clear from the description that follows, such a breath strip case according to the invention includes an open base having a cavity defined by a bottom surface and a first plurality of side walls—along with a cover having a top surface, a second plurality of side walls, and an opening in the top surface for accessing the cavity. The case further includes a lid having length, width and depth dimensions to snugly overlie the cover once the cover is closed. First and second sets of projections extend outwardly along the first and second pluralities of side walls, respectively positioned so as to secure together when the cover is closed over the base.

In a preferred embodiment of the invention, the breath strip case is constructed with the sets of projections being positioned so as to secure the base with the cover once closed in a non-easily openable fit. The lid, at the same time, is arranged to snugly overlie the cover once closed in a substantially air-tight manner. In this preferred construction, as will be seen, the cover is coupled to a first end of the base in the rotatable closing of the base; the lid, at such time, is coupled to a second, opposite end of the base to rotatably open and close over the cover. As will be described, the cover is coupled to rotatably close the base when rotated in one of a clockwise and counterclockwise direction, while the lid is coupled to open and close atop the cover in a clockwise or counterclockwise rotation, opposite to that of the cover rotation. In a fabrication which allows the removal of individual oral breath strips in a sanitary fashion, the cavity of the base is selected to slope downwardly toward the second, opposite end of the base; at the same time, the cavity slopes upwardly above the base towards the top surface opening when the cover closes over the base.

With the base, cover and lid each composed of a clear plastic—preferably a flexible plastic—, upwards rotation of the lid from the cover exposes the cover's opening to permit access through to the individual breath strips; because of the substantially air-tight fit between the lid and the cover, until such time, the oral breath strips are protected from any airborne contaminants that might be present. To facilitate the upwards rotation of the lid, a tab is provided, outwardly extending from an end of the lid remote from the base. To protect the oral breath strips against "tampering", the cover enclosing the strips within the cavity will be appreciated as being "hard-to-open". To accomplish this in the preferred construction of the invention, the first and second sets of projections are selected as separate tracks extending outwardly along the pluralities of side walls of the base and cover, and at positions where they snap together in closing the cover over the base. An effective "locking" of the cover and base thus results.

As will be appreciated by those skilled in the art, ease of carrying follows by snapping the cover over the base, and snugly closing the lid over the cover to seal off its opening. When a breath strip is to be removed, the tab on the lid is simply grasped, and the lid rotated open—to thereby expose the opening in the cover through which the user can then reach in removing one or more oral breath strips as the case may be from the cavity storage within the base.

BRIEF DESCRIPTION OF THE DRAWING

These and other features of the invention will be more clearly understood from a consideration of the following description, taken in conjunction with the sole FIGURE of the Drawing illustrating the resealable sectional breath strip case of the invention when open.

DETAILED DESCRIPTION OF THE INVENTION

Figure 1:
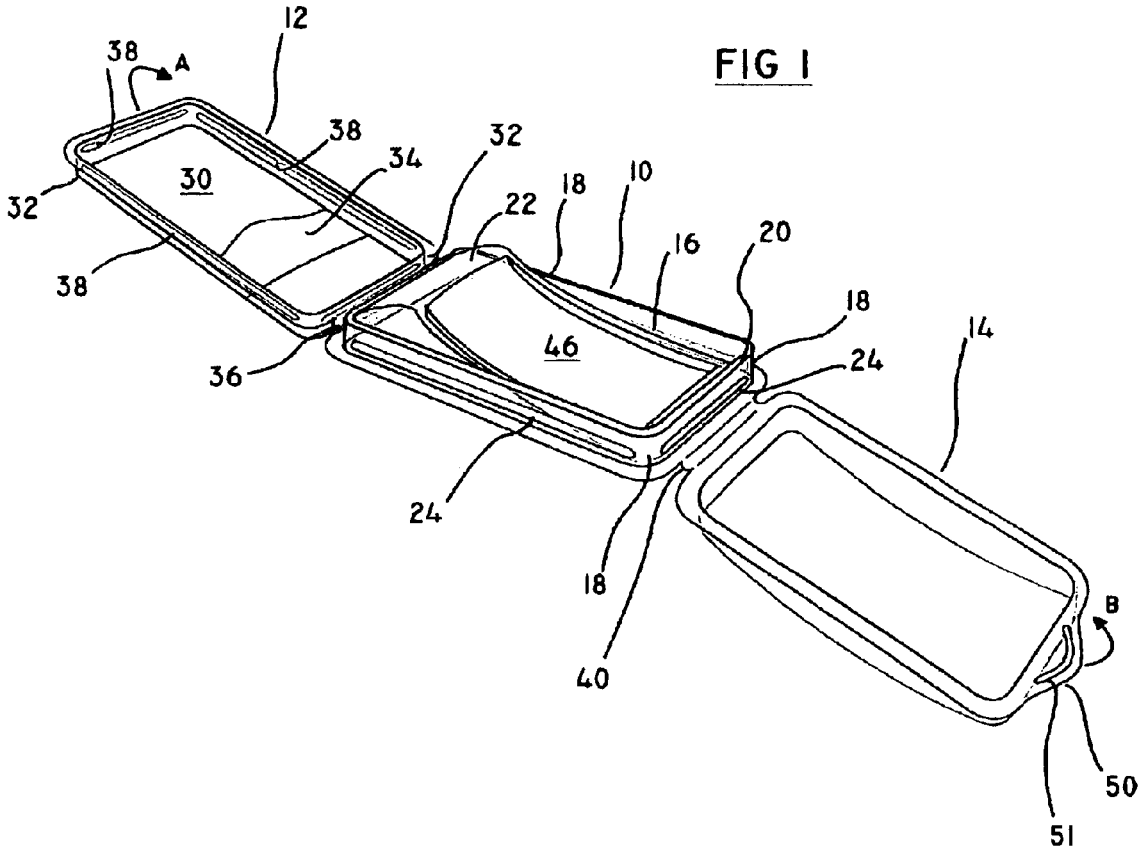

The breath strip case of the invention includes an open base 10, a cover 12, and a lid 14. As illustrated, the base 10 includes a cavity defined by a bottom surface 16 and a plurality of side walls generally shown as 18. Such cavity 16 slopes downwardly toward an end 20 of the base 10 and slopes upwardly above the base to a point 22. A plurality of oral breath strips rest in the cavity, as shown at 46. As these breath strips are commonly of a 0.875 inch width and of a 1.25 inch length, the cavity area is constructed so as to allow storage of a depth approximating 0.25 inch in accommodating some 30 or so individual oral breath strips. In accordance with the invention, a first set of projections—shown as individual tracks 24—extend outwardly along the side walls 18.

As shown, the cover 12 has a top surface 30, a second plurality of side walls 32 and an opening 34 in the top surface for accessing the breath strips 46. A first end 36 of the base 10 is coupled with the cover 12 to allow rotatable closing of the base when rotating the cover 12 clockwise in the direction of the arrow A as shown in the drawing, or counterclockwise if the configuration of the drawing were reversed 180°. The cover 12 additionally includes a second set of projections 38—also, preferably in the form of tracks—extending outwardly along its side walls 32; and, positioned so as to secure with the projections 24 of the base 10 once the cover 12 is rotated in the direction of the arrow A to close over the base. Closing the cover 12 thus allows for the breath strips 46 to be removed through the opening 34. As will be appreciated, such opening 34 sits just forward of the raised area of the cavity at the point 22. In positioning and dimensioning the two sets of projections 24, 38, selection is made so that they effectively snap into place, and are not easily reopenable. Access to the breath strips 46 is then through the opening 34.

The lid 14, on the other hand, is selected of length, width and depth dimension so as to snugly overlie the cover 12 once the cover 12 closes over the base 10. To such end, the lid 14 is coupled with a second, opposite end 40 of the base 10 so as to rotate in a clockwise or counterclockwise rotation opposite to that of the rotation of the cover 12 in closing the open base 10. Thus, in the orientation shown in the drawing, rotation of the lid 14 in the counterclockwise direction shown by the arrow B effectively closes the opening 34 once the lid 14 is rotated atop the cover 12. In accordance with the invention, when selecting the lid 14, its length, width and depth dimensions are chosen so as to form a substantially air-tight fit when closed atop the cover 12 through the counterclockwise rotation in the direction of the arrow B. Such air-tight fit prevents moisture from entering into the breath strip cavity 16, as well as to protect against airborne contaminants reaching the strips 46. To facilitate the closing of the lid 14 in the direction of the arrow B, and its subsequent opening through a reverse rotation, a tab 50 is included at the end of the lid 14 remote from the base so as to be easily grasped in pulling the lid opened and closed—along with a cavity or plurality 51 in the tab 50 to allow a better grip when opening the tab.

As will be readily appreciated by those skilled in the art, a simple-to-carry, openable and closable breath strip case can be had by constructing the base 10, cover 12 and lid 14 of a clear plastic, preferably one which is flexible. The end result will be seen to be a resealable case for oral breath strips having a base including a cavity, a cover closing the base but having an opening in a top surface for accessing the cavity, and a lid for opening and closing the cover. With the cover then closing the base in a non-easily openable fit, and with the lid snugly overlying the cover when closed in a substantially air tight fit, the resealable sectional breath strip case of the invention becomes easy to carry and easy to utilize—as well as one which secures the breath strips in a manner in which they are protected from ambient elements. As will be seen, the effective "locking together" of the base 10, the cover 12 and the lid 14 affords a further degree of moisture barrier protection,not present in other breath strip cases on the market today.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A breath strip case comprising:

an open base having a cavity defined by a bottom surface and a first plurality of side walls;

a cover having a top surface, a second plurality of side walls, and an opening in said top surface for accessing said cavity;

a lid having length, width, and depth dimensions to snugly overlie said cover when closed atop said cover;

a first set of projections extending outwardly along said first plurality of side walls;

and a second set of projections extending outwardly along said second plurality of side walls;

with said first and second sets of projections being respectively positioned to secure together when closing said cover over said base.

2. The breath strip case of claim 1 wherein said sets of projections are positioned to secure said base with said cover when closed in a non-easily openable fit.

3. The breath strip case of claim 2 wherein said lid snugly overlies said cover when closed atop said cover in a substantially air-tight fit.

4. The breath strip case of claim 3 wherein said cover is coupled to a first end of said base to rotatably close said base.

5. The breath strip case of claim 4 wherein said lid is coupled to a second, opposite end of said base to rotatably open and close said cover.

6. The breath strip case of claim 5 wherein said cover is coupled to rotatably close said base in one of a clockwise and counterclockwise rotation, and wherein said lid is coupled to open and close atop said cover in clockwise or counterclockwise rotation opposite to that of said cover rotation.

7. The breath strip case of claim 6 wherein said first and second sets of projections comprise tracks extending outwardly along said first and second pluralities of side walls to snap together when closing said cover over said base.

8. The breath strip case of claim 6 wherein said cavity of said base slopes downwardly toward second, opposite end of said base.

9. The breath strip case of claim 8 wherein said cavity slopes upwardly above said base towards said top surface opening when said cover is closed over said base.

10. The breath strip case of claim 6, also including a tab outwardly extending from an end of said lid remote from said base.

11. The breath strip case of claim 6, wherein said base, said cover and said lid are each composed of a clear plastic.

12. The breath strip case of claim 6 wherein said base, said cover and said lid are each composed of a flexible plastic.

13. The breath strip case of claim 6, also including a plurality of oral breath strips within said cavity of said base.

* * * * *